US005483212A

United States Patent [19]

Lankuttis et al.

[11] Patent Number: 5,483,212

[45] Date of Patent: Jan. 9, 1996

[54] OVERLOAD RELAY TO BE COMBINED WITH CONTACTORS

[75] Inventors: Klaus Lankuttis, Bonn; Gerhard Rossmann, Karlsruhe, both of Germany

[73] Assignee: Klöckner-Moeller GmbH, Bonn, Germany

[21] Appl. No.: 137,574

[22] Filed: Oct. 14, 1993

[30] Foreign Application Priority Data

Oct. 14, 1992 [DE] Germany ..... 42 34 619.3

[51] Int. Cl.[6] ..... H01H 67/02

[52] U.S. Cl. ..... 335/132; 335/202

[58] Field of Search ..... 335/131, 132, 335/202

[56] References Cited

U.S. PATENT DOCUMENTS

| | | | |
|---|---|---|---|
| 4,006,440 | 2/1977 | Burton et al. | 335/132 |
| 5,159,304 | 10/1992 | Yamagata et al. | 335/202 |

FOREIGN PATENT DOCUMENTS

| | | |
|---|---|---|
| 0219570 | 4/1987 | European Pat. Off. . |
| 1465880 | 9/1969 | Germany . |
| 2717444 | 10/1978 | Germany . |
| 3037405 | 5/1982 | Germany . |
| 3224144 | 12/1983 | Germany . |
| 2625603 | 7/1989 | Germany . |
| 8434232 | 12/1989 | Germany . |
| 9108605 | 11/1991 | Germany . |

OTHER PUBLICATIONS

Siemens Katalog NS 2, Schalten & Überwachen, Niederspannungs–Schältgerate und Systeme, pp. 4/2, 13 and 11/7, 8, 23.

Klöckner–Moeller–Post, No. 89, Apr. 1976, pp. 27–32.

*Primary Examiner*—Lincoln Donovan

*Attorney, Agent, or Firm*—Nils H. Ljungman & Associates

[57] ABSTRACT

An overload relay comprising three modules, each enclosed in molded housings: the basic unit, the contactor-side terminal block and the load-side terminal block. Both terminal blocks have phase connectors which can be the same or different in terms of their type of connection and/or their clearance between phases and/or their phase height. The terminal blocks can be mechanically and electrically detachably connected to the basic unit. At least the basic unit or the terminal blocks have means for fastening to a mounting plate. In an additional solution, the terminal blocks are part of a series which is compatible with at least two different contactors. A typical field of application for the invention is the protection of electric motors.

20 Claims, 4 Drawing Sheets

OVERLOAD RELAY TO BE COMBINED WITH CONTACTORS

BACKGROUND OF THE INVENTION

1. Field of the Invention

The present invention generally relates to overload relays to be combined with contactors. Such overload relays are located in series between a contactor and the electrical load to be switched and protected against overload. The present invention relates in particular to overload relays with thermally delayed overload tripping, with magnetic short circuit tripping, or with a combination of the two types of tripping, but also to overload relays equipped with current transformers. A typical area of application is in the protection of motors.

2. Background Information

Such an overload relay to be combined with a contactor, with bimetal trip elements for each current phase to be protected, is disclosed in French Patent 2 625 603 A1. This overload relay, on the side toward the contactor, has non-withdrawable plug-in connectors, as phase connectors. These plug-in connectors can be connected to terminal clamps of the contactor. For this purpose, on one hand, the plug-in connectors are designed so that they will be compatible, in terms of phase separation and phase height (i.e. in terms of the connection geometry) with the terminal clamps of the contactor, and on the other hand, the overload relay can be snapped onto the contactor. On the side toward the load, the overload relay has non-withdrawal terminal clamps as phase connectors. The terminal connectors of the overload relay do not tend to have the same connection geometry as the terminal connectors of the contactor, which complicates matters for the user in terms of design, installation, service and maintenance. The scope of application is also limited to combinations with contactors of the same structure and size. Employing this solution, it is generally impossible to use the components for individual mounting or installation as isolated units.

Siemens Catalogue NS 2/1991 (Pages 4/13 and 11/7, 8, 23) shows that a thermally delayed overload relay 3UA60, on the contactor side, has non-withdrawable, flat-type plug-in connectors which are compatible with the relay-side terminal connectors of a 3TF50 contactor to be connected to it, and contains additional means for snapping onto a top-hat rail, or DIN rail, or for bolting to a mounting plate. The load-side terminal connectors of the overload relay have the same connection geometry as the relay-side terminal connectors of the contactor, which makes them easier to use. This solution also makes it possible to mount the components individually, because they can be inserted into a relay base 3UX1 424 designed as a box terminal package by means of the plug-in connectors of the overload relay and connected to the latter, to make possible the connection of the phase conductor. In an additional combination of a 3TF51 contactor and a 3UA61 overload relay, the overload relay has flat-type connectors on both sides, which have holes for screw connections and are compatible with the flat-type connectors of the contactor in terms of their connector type and geometry. But a disadvantage of these solutions is that it is difficult or impossible to combine the overload relays with contactors which have different connector types and geometries. There are comparable problems with regard to different phase conductors departing from the overload relay and leading to the load.

As indicated in KLOCKNER-MOELLER-POST, Volume 89, April 1976, pages 27–32, an overload relay equipped with load-side terminal clamps is designed as a basic unit, to which can be bolted a contactor-side terminal block designed as a non-enclosed elbow-coupling component, the height of which can be adjusted within certain limits. The elbow-couplings are plug-in connectors, which make possible a direct connection with a contactor—but only if the contactor is equipped with terminal clamps. The overload relay can only be fastened to a mounting plate by means of the basic unit. The availability of different terminal blocks makes it possible to adapt the contactor side of the overload relay to contactors of a series having a different phase geometry—but not for the load side of the overload relay. For individual mounting of the overload relay, there is a terminal block which has clamp connectors.

German Patent 84 34 232 U1 also discloses an overload relay which consists of a basic unit with load-side clamp connectors and a contactor-side, enclosed terminal block. The terminal block is electrically connected to the basic unit by means of detachable plug-in connectors, and is mechanically connected to the basic unit by means of locking connections. The overload relay can be individually mounted using a terminal block equipped with clamp connectors. By using a terminal block equipped with plug-in connectors, the overload relay can be directly combined with a contactor, but only if the contactor is equipped with clamp connectors. By means of an appropriate crimping, or offsetting, of the plug-in connectors, the overload relay can also be connected to contactors with different phase separations. The load-side of the overload relay is also compatible with regard to the phase separation of a contactor—but a load-side adjustment to contactors with different phase separations is essentially not possible. The overload relay, as such, can essentially only be fastened to a mounting plate by means of the basic unit. The plug-in connection between the basic unit and the terminal block tends to make the overload relay unsuitable for use in high-intensity current applications.

OBJECT OF THE INVENTION

The object of the invention is therefore to make possible, in a simple and user-friendly manner, using a generic overload relay and various types of fastening possibilities, combinations with contactors and output-side phase conductors which are different in terms of the type and geometry of their connections.

SUMMARY OF THE INVENTION

The invention teaches that this object can be achieved by means of an overload relay having the following characteristics:

- the overload relay comprises a basic unit enclosed in a molded housing, the overload relay containing the overload protection mechanisms;
- the overload relay further comprises a terminal block equipped on the contactor side with phase connectors, this terminal block being enclosed in a molded housing;
- the overload relay further comprises a terminal block equipped on the load side with phase connectors, this terminal block also being enclosed in a molded housing; and
- the terminal blocks are mechanically and electrically detachably connected to the basic unit;
- at least the basic unit or the terminal blocks has or have means for fastening to a mounting plate.

Essentially, both of the terminal blocks which can be easily connected to the basic unit, can be identical or different on the contactor-side and the load-side, to meet the different connection and combination requirements of the corresponding contactor and load side. By employing this modular construction, it is essentially a simple matter to make a direct connection between the overload relay and the contactor with which it is to be combined, or an indirect connection of the two components, in particular an individual mounting. The modules of the overload relay can be mounted individually or jointly on the mounting plate, either solely by means of the basic unit or solely by means of the terminal blocks. When the modules are mounted jointly, the module or modules not directly mounted on the mounting plate are thus also effectively mounted. In a particularly advantageous manner, this latter type of mounting can be achieved via the mechanical and electrical connection of the terminal blocks to the basic unit.

Other advantageous configurations of the solution discussed hereinabove are disclosed hereinbelow. The contactor-side compatibility of the terminal block is used in particular for the direct connection of the overload relay and the contactor. The load-side compatibility of the terminal block essentially makes it easier for the user to understand, among other things, the geometric and functional correspondence between the load side of the overload relay and the output side of the contactor, and thus makes the entire system easier to use (i.e. in terms of recognition and familiarity).

The object is also achieved by other features disclosed hereinbelow. For example, the terminal blocks are preferably from a series which advantageously meets the connection requirements for the combination of the overload relay with different contactors which—apart from the differences in their electrical parameters—are different in terms of their type of connection, their phase height and their phase separation. Thus, also, the terminal blocks can also be used with different models of output-side phase conductors or any downstream switching devices which may be connected. The terminal blocks of the series can theoretically be used both on the contactor-side and on the load side. For a number of combinations with different contactors, this flexible modular system—naturally as long as it complies with the electrical requirements—requires essentially only a single basic unit of the overload relay. The basic unit can be adapted by means of the terminal blocks to meet the current connection requirements in various ways, both on the contactor side and on the load side. Thus, on one hand, the modular system can be adapted by any appropriate modifications to newly-developed contactors in a given series of contactors, and on the other hand, can be adapted to newly-developed series of contactors from the same manufacturer, or to contactors from other manufacturers. A circuit which contains a contactor can also be retrofitted with an overload relay in which case—as is generally desirable—the type and geometry of the load-side connection can be retained, which has significant advantages for the user, including the use of the same tools to connect the contactor and the overload relay. The advantages described further above in the first paragraph of the Summary of the Invention and not repeated here are also applicable in this case.

Even further advantageous and appropriate configurations of the present invention are disclosed hereinbelow. Particularly, the present invention provides for reliable means for the simultaneous mechanical and electrical connection of the terminal blocks to the basic unit. The overload relay is adaptable to different phase intervals and phase heights by means of particular characteristics disclosed hereinbelow. At this point, it should be noted that the basic unit, from an electrical point of view, represents a high-value unit for overload protection. In this case, the contactor-side and load-side connections could also be made by means of the threaded connectors present on the basic unit.

The plug-in connections disclosed hereinbelow allow, in particular, for the connection of the overload relay director to a contactor by means of its relay-side terminal connections. It is of particular advantage if, as disclosed hereinbelow, a plug-in package identical with that of the contactor is used as the terminal block. A configuration of the plug-in connectors disclosed hereinbelow results in a particularly advantageous connection capability between the terminal block and the basic unit. The flat-type connectors of the plug-in connectors disclosed hereinbelow also make possible, in addition to the plug-in connection by means of clamp connectors of a contactor, a screw-connection with flat-type connectors of a contactor, or with incoming or outgoing flat conductors. Other characteristics disclosed hereinbelow, in particular in a simple configuration disclosed hereinbelow, makes it possible to adapt the phase connections of the overload relay to the phase height of the relay-side contactor connections or to different incoming or outgoing connections or conductors, within certain limits.

The present invention also provides that an overload relay equipped with plug-in connectors can be retrofitted with clamp connectors, for example, to make possible a simple individual mounting. It is thereby of particular advantage if, as disclosed hereinbelow, the same relay base is used as for the contactor, whereby, for example, when the relay base is used on the load side, the same optical impression is given at the outputs of the contactor and of the overload relay, to make the system easier for the user to understand. The clamp connectors disclosed hereinbelow can also be used for mounting the overload relay individually and also to make the system easier to understand. In this case, the location of the screw connection between the terminal block and the basic unit disclosed hereinbelow is particularly appropriate. A terminal block, as disclosed hereinbelow, which can be the same as the one used for the contactor yields advantages cited further above in relation to the same relay base being used as for the contactor. The use of box terminals, as hereinbelow, is also appropriate. The covering of the terminal connections, as disclosed hereinbelow, prevents accidental contact, and is particularly appropriate with a cover which can be the same as the one used for the contactor, as also disclosed hereinbelow.

If an additional mechanical connection of the components of the overload relay is required, it can be achieved by other means disclosed hereinbelow. The configuration of the additional connecting means on the bottom, as disclosed hereinbelow, makes it possible to mount the overload relay by bolting the overload relay to a mounting plate or similar device or by snapping it onto a top-hat rail. The present invention also makes it possible to use either of the above-mentioned types of fastening. Finally, the detachable mechanical and electrical connection of a control switch, or auxiliary switch, on the top of the basic unit is appropriate.

In summary, one aspect of the invention resides broadly in an overload relay and contactor in combination, the overload relay for being interfaced with an electrical load, at least a portion of the combination for being mounted on a mounting plate, the combination comprising: the overload relay comprising a base unit, a first terminal block and a second terminal block; the base unit being disposed between the first terminal block and the second terminal block; the first terminal block being selectively detachable and attachable with the base unit; the second terminal block being selectively detachable and attachable with the base unit; means for connecting the first terminal block with the base unit; means for connecting the second terminal block with the base unit; the first terminal block being disposed adjacent the contactor and being selectively attachable and detachable with the contactor; the second terminal block being configured for being connected with the electrical load and for being selectively attachable and detachable with the electrical load; means disposed on the first terminal block for connecting the first terminal block with the contactor; means disposed on the second terminal block for connecting the second terminal block with the electrical load; the means connecting the first terminal block with the contactor comprising first phase connector means; the means for connecting the second terminal block with the electrical load comprising second phase connector means; and the base unit comprising overload protection means.

Another aspect of the invention resides broadly in an overload relay for being connected with a contactor, the overload relay for being interfaced with an electrical load, at least a portion of the overload relay for being mounted on a mounting plate, the overload relay comprising: a base unit, a first terminal block and a second terminal block; the base unit being disposed between the first terminal block and the second terminal block; the first terminal block being selectively detachable and attachable with the base unit; the second terminal block being selectively detachable and attachable with the base unit; means for connecting the first terminal block with the base unit; means for connecting the second terminal block with the base unit; the first terminal block being disposed adjacent the contactor and being selectively attachable and detachable with the contactor; the second terminal block being configured for being connected with the electrical load and for being selectively attachable and detachable with the electrical load; means disposed on the first terminal block for connecting the first terminal block with the contactor; means disposed on the second terminal block for connecting the second terminal block with the electrical load; the means connecting the first terminal block with the contactor comprising first phase connector means; the means for connecting the second terminal block with the electrical load comprising second phase connector means; and the base unit comprising overload protection means.

Yet another aspect of the invention resides broadly in a method of using a system for adapting various overload relays to various contactors, the overload relays and the contactors for being interfaced with an electrical load, the method comprising the steps of: providing a plurality of overload relays; providing a plurality of contactors; providing a first set of adapters, each adapter of the first set of adapters for connecting at least one of the overload relays with at least one of the contactors; providing a second set of adapters, each adapter of the second set of adapters for connecting at least one of the overload relays with the electrical load; selecting a first adapter from the first set of adapters and connecting the first adapter of the first set of adapters between a first one of the plurality of overload relays and a first one of the plurality of contactors; and selecting a first adapter from the second set of adapters and connecting the first adapter of the second set of adapters between the first overload relay and the electrical load.

BRIEF DESCRIPTION OF THE DRAWINGS

The invention and additional advantageous features are explained in greater detail below, with reference to the embodiments illustrated in the accompanying drawings.

DESCRIPTION OF THE PREFERRED EMBODIMENTS

Figure 1:
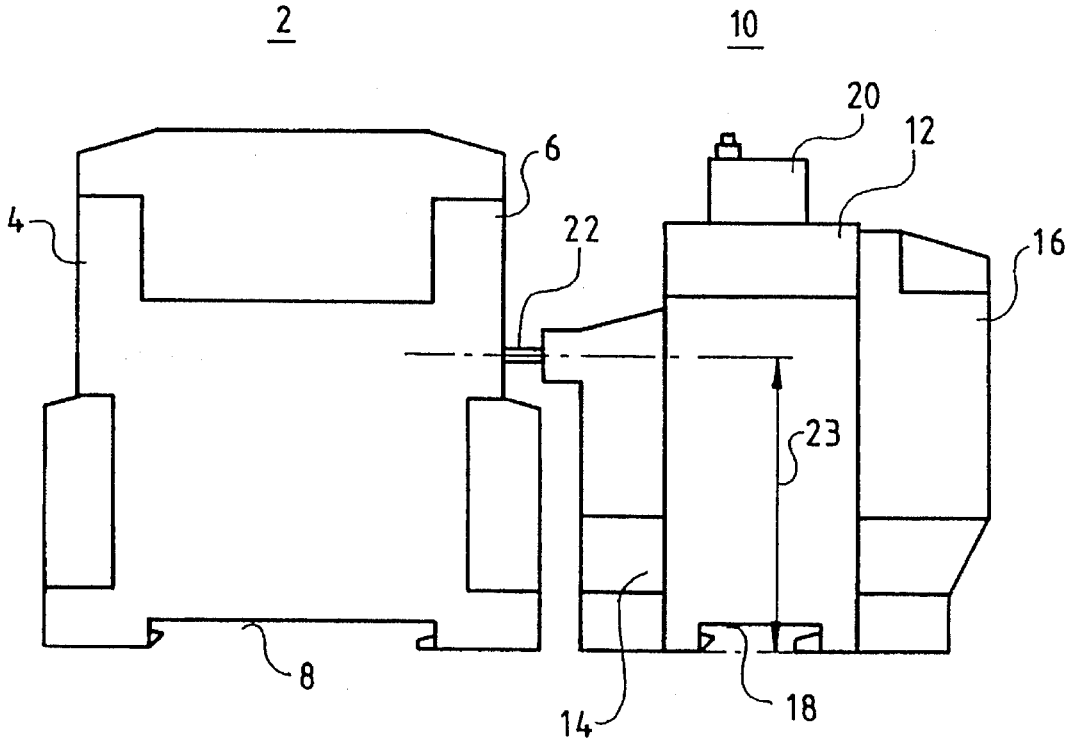
FIG. 1: an overload relay according to the invention in combination with a contactor, in a side view.
Figure 2:
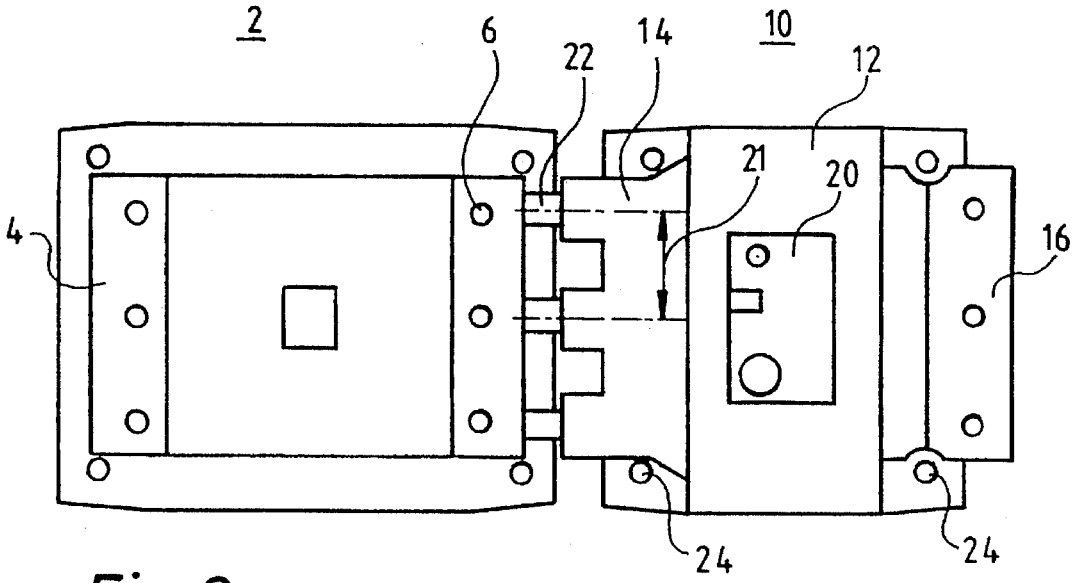
FIG. 2: the same as above, in a plan view.

FIGS. 1 and 2 show a contactor 2 and an overload relay 10 connected directly thereto. The contactor, for each of three phases, preferably has clamp connectors 4 on the power supply side, and clamp connectors 6 on the relay side. The contactor 2 also preferably has snap fasteners 8 so that the contactor 2 can be snapped onto a top-hat rail (not shown). The overload relay 10 preferably includes a basic unit 12, a contactor-side terminal block 14 and a load-side terminal block 16. The basic unit 12 preferably contains known overload protection mechanisms to protect the downstream load from an overload, in particular from overcurrents, and is preferably enclosed in a molded housing, The basic unit 12, on its underside, preferably has snap fastening means 18. Preferably, fastened on the upper side of the basic unit 12 is a control switch 20. Such a control switch is well known to those of ordinary skill in the art and, as such, will not be discussed in further detail here.

The contactor-side terminal block 14 is enclosed in a molded housing and has three phase connections designed as plug-in connections 22, which extend into terminal compartments of the relay-side terminal connections 6 of the contactor 2, and are preferably connected to contactor 2. Compatibility therefore exists, i.e. with regard to both the type and the geometry of the connections defined by the phase separation 21 and the phase height 23, between the relay-side phase connections of the contactor 2 and the contactor-side phase connections of the overload relay 10. The load-side terminal block 16 is also preferably enclosed in a molded housing and can preferably have three phase connections designed as clamp connectors. The terminal blocks 14 and 16, on their undersides, each preferably have two screw fastening means 24 in the form of lateral extensions with holes. The three modules—the basic unit 12, the contactor-side terminal block 14 and the load-side terminal block 16—are preferably mechanically and electrically connected to one another as described in greater detail below.

In a preferred embodiment of the present invention, the overload relay 10 can preferably be fastenable to a mounting plate, preferably solely by the snap fastening means 18 of the basic unit 12 to a top-hat rail (not shown) or preferably by means of the screw fastening means 24 of the terminal blocks 14 and 16. The overload relay 10, in terms of the type and geometry of its load-side connection, preferably corresponds to the type and geometry of the relay-side connection of the contactor 2. As a result of this compatibility of the phase connections, the system essentially becomes easier for the user to understand, and the handling and installation of the system components is significantly facilitated on account of the familiarity it induces.

Figures 3, 4, 5:
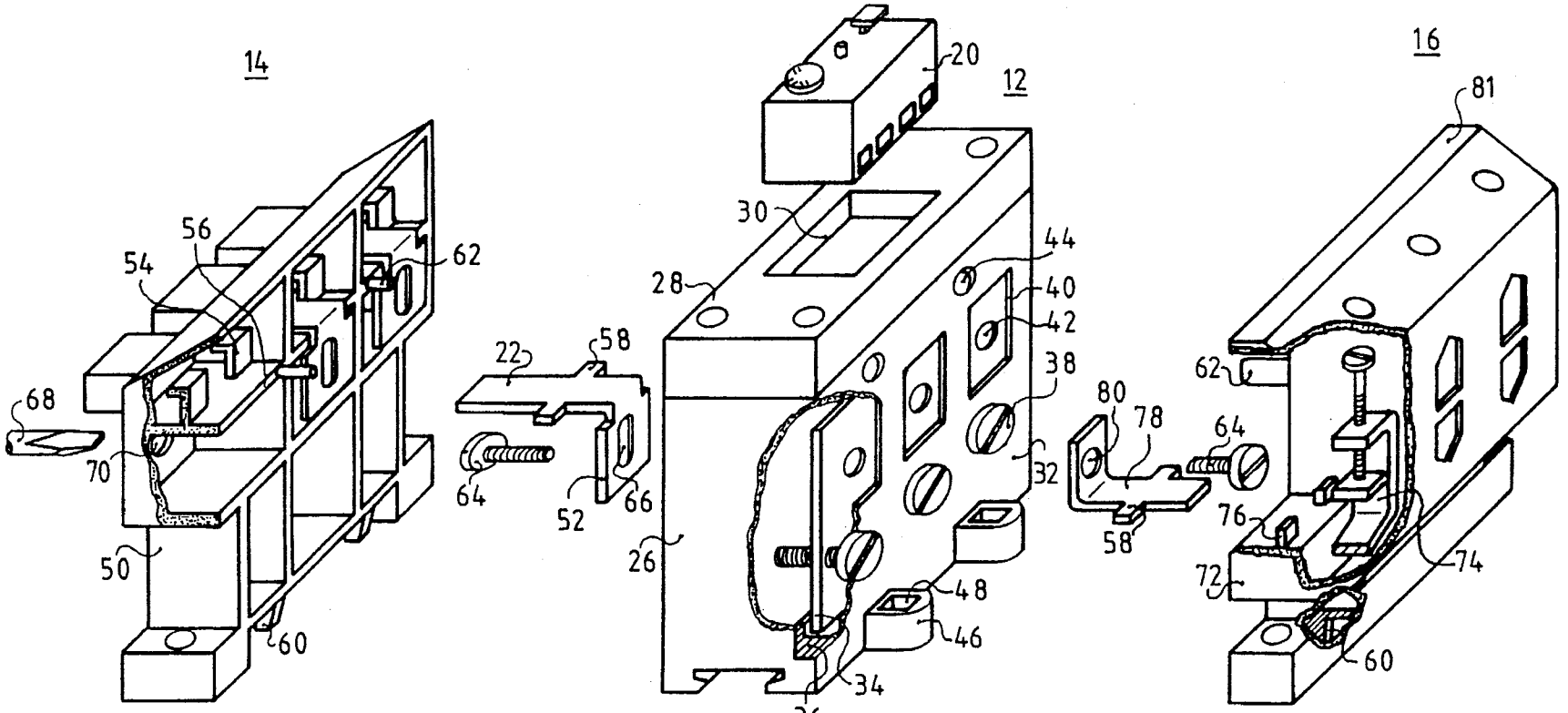
FIG. 3: a partly-exploded drawing in perspective, and with cutaways for purposes of illustration, of a basic unit as illustrated in FIG. 1.
FIG. 4: likewise, a contactor-side terminal block as illustrated in FIG. 1.
FIG. 5: likewise, a load-side terminal block as illustrated in FIG. 1.

FIGS. 3 to 5 show in detail the structure and connections of the modules of the overload relay 10 illustrated in FIGS. 1 and 2, in accordance with a preferred embodiment of the present invention. As shown in FIG. 3, the basic unit 12 is enclosed on all sides by a molded housing 26, the cover 28 of which has a recess 30 for the mounting and fastening of the control switch 20. On the inside wall of the molded housing surface 32 facing the load-side connection block 16, at the phase separation, three connection plates 34 made of conductive material are preferably fastened by means of slots 36 and retaining screws 38. Portions of the connecting plates 34 are preferably accessible from the outside through rectangular openings 40, and have threaded holes 42 in these areas. As part of additional mechanical connecting means for the modules, there are preferably two blind holes 44 on the surface 32 of the molded housing above the openings 40, and on the bottom there are preferably two connection extensions 46, each with a slot 48. Preferably, on the opposite surface of the molded housing facing the contactor-side terminal block 14, there are similar adapter plates 34, slots 36, retaining screws 38, openings 40, threaded holes 42, blind holes 44, connection extensions 46 and slots 48.

As shown in FIG. 4, the contactor-side terminal block 14 preferably includes a molded housing in the form of a ribbed shell 50 and the three plug-in connections 22. The plug-in connections 22 are preferably made of a piece of conductive material with a first connector 52 bent at right angles. The plug-in connectors 22 and connectors 52 are each preferably inserted between two upward-pointing L-shaped moldings 54 located approximately at the phase height. They are preferably limited in their downward vertical movement by the upper inside cross rib 56, and in their upward vertical movement by contact with the two lateral stop brackets 58 of the first connector 52 on the upper, horizontal leg of the L-shaped moldings 54. The inserted plug-in connectors 22 or connectors 52 are preferably limited in their horizontal movement toward the basic unit 12 by their contact with the stop bracket 58 on the lower, vertical leg of the L-shaped moldings 54. As part of the additional connecting means of the modules, on the lower portion of the shell 50, there are preferably two downward-pointing connecting pegs 60, and in the upper half of the shell 50 there are preferably two pins 62 pointing toward the basic unit 12.

The contactor-side terminal block 14 is preferably fastened to the basic unit 12 by inserting the connecting pegs 60 into the slots 48 of the corresponding connecting extensions 46 on the basic unit 12, and the pins 62 into the corresponding blind holes 44 of the basic unit 12. The electrical and mechanical connection, strictly speaking, is preferably made by three machine screws 64, each of which extends with its shaft through a slot 66 in the vertically-oriented leg of the first connectors 52, and into the threaded holes 42 in the corresponding adapter plates 34 of the basic unit 12. These screws are preferably inserted by means of a screwdriver 68, the tip of which is preferably inserted through each of the screw openings 70 in the shell 50 below the plug-in connections 22, and which is preferably turned in the direction of the phase access. The mounting of the plug-in connections 22 and connectors 52 in the shell 50 and the connection via the slots 66 essentially makes it possible, within certain limits, to adjust the phase height of the plug-in connectors 22—and thus the contactor-side phase height of the overload relay—to the phase height of the upstream contactor.

The load-side terminal block 16 illustrated in FIG. 5 preferably includes an additional molded housing 72 with three clamp connectors mounted therewithin, which clamp connectors can preferably be designed as box terminals 74. Between each two square-shaped moldings 76 of the additional molded housing 72 at approximately half the height of the box terminals 74, there is preferably a second connector 78 made of a piece of conductive material and bent at right angles. In the same manner as for the contactor-side terminal block 14, the load-side terminal block 16 is preferably held in place by means of two pegs 60 and two pins 62 in the corresponding slots 48 and blind holes 44 of the basic unit 12. The mechanical and electrical connection, strictly speaking, between the load-side terminal block 16 and the basic unit 12 is preferably made by means of three machine screws 64, which extend through the terminal compartments of the box terminals 74, each through a hole 80 in the vertically-oriented leg of the second connector 78, and are preferably screwed into the threaded holes of the corresponding adapter plate 34. The positive connection is thereby achieved in each case essentially by two lateral stop brackets 58 on the second connector 78, which are preferably in contact against the side of the square-shaped moldings 76 facing the load. The end of the horizontally-oriented leg facing the load of each second connector 78 preferably extends into the corresponding terminal compartment, and is thus preferably a mechanical and electrical component of the corresponding box terminal 74. For protection against accidental contact with the live box terminals 74, there is preferably a transparent cover 81 which can be snapped onto the load-side terminal block 16 from above.

Figure 6:
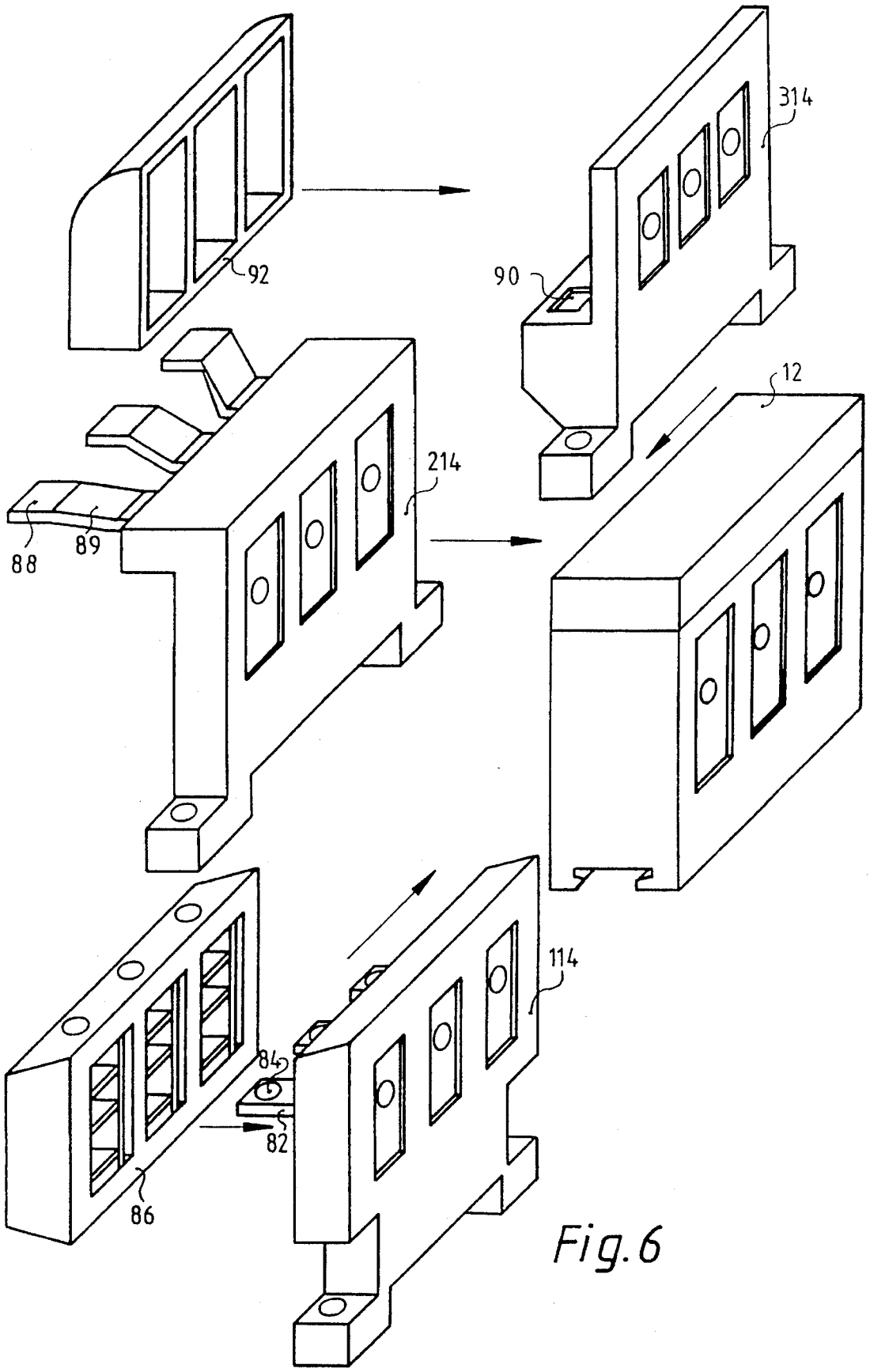
FIG. 6: a schematic illustration of various contactor-side embodiments of the overload relay according to the invention.

FIG. 6 shows how the basic unit 12, can, in addition to the contactor-side terminal block 14 illustrated in FIG. 4, can be connected with a selection of other terminal blocks 114,214 and 314, all of the same series, on the contactor side, to suit different types of connection requirements. The contactor-side terminal block 114 illustrated in the lower portion of the figure is preferably designed with plug-in connections designed as flat-type connectors 82 and connecting holes 84. The flat-type connectors 82 can preferably be clamped directly to suitable clamp connectors of a contactor. Flat-type connectors 82 can also be directly bolted to compatible flat-type connectors of a contactor. However, when the contactor and overload relay components are mounted individually, they can also be connected with flat conductors, the other ends of which are connected to a contactor. If, when the components are mounted individually, clamped conductors are used, a relay base designed as a box terminal unit 86 can preferably be inserted over the flat-type connectors 82, and can be mechanically and electrically connected to flat-type connectors 82 by means of screws (not shown). An additional advantage of this arrangement is that the box terminal unit 86 can essentially be a relay base which comes from the same series of contactors being combined with the overload relay. The contactor-side terminal block 214, shown in the middle, also preferably has plug-in connections 88 as the phase connectors, which are bent to form third connectors 89. To achieve compatibility with the connection geometry of larger contactors, the third connectors 89 can preferably be crimped in two directions perpendicular to one another. Since, on one hand, the phase separation of the basic unit 12 is smaller than that of a directly-connected contactor 2 (such as shown in FIG. 1), the two connectors outside the third connector 89 can preferably be crimped outwardly. On the other hand, since the phase height of the basic unit 12 is smaller than that of the directly-connected contactor, all three connectors 89 can also preferably be crimped upwardly. The contactor-side terminal block 314, shown in the upper portion of FIG. 6, is preferably used for the individual mounting of the components, and is preferably equipped with known clamp connectors, in which the incoming phase conductors from the contactor can be suspended from above. After the clamping of the phase conductors, the clamp connectors 90 can preferably be protected against accidental contact by a cover 92 which is installed from the front. An additional advantage of this arrangement is that the cover 92 can preferably be taken from a contactor of the same series as the contactors to be combined with the overload relay.

Figure 7:
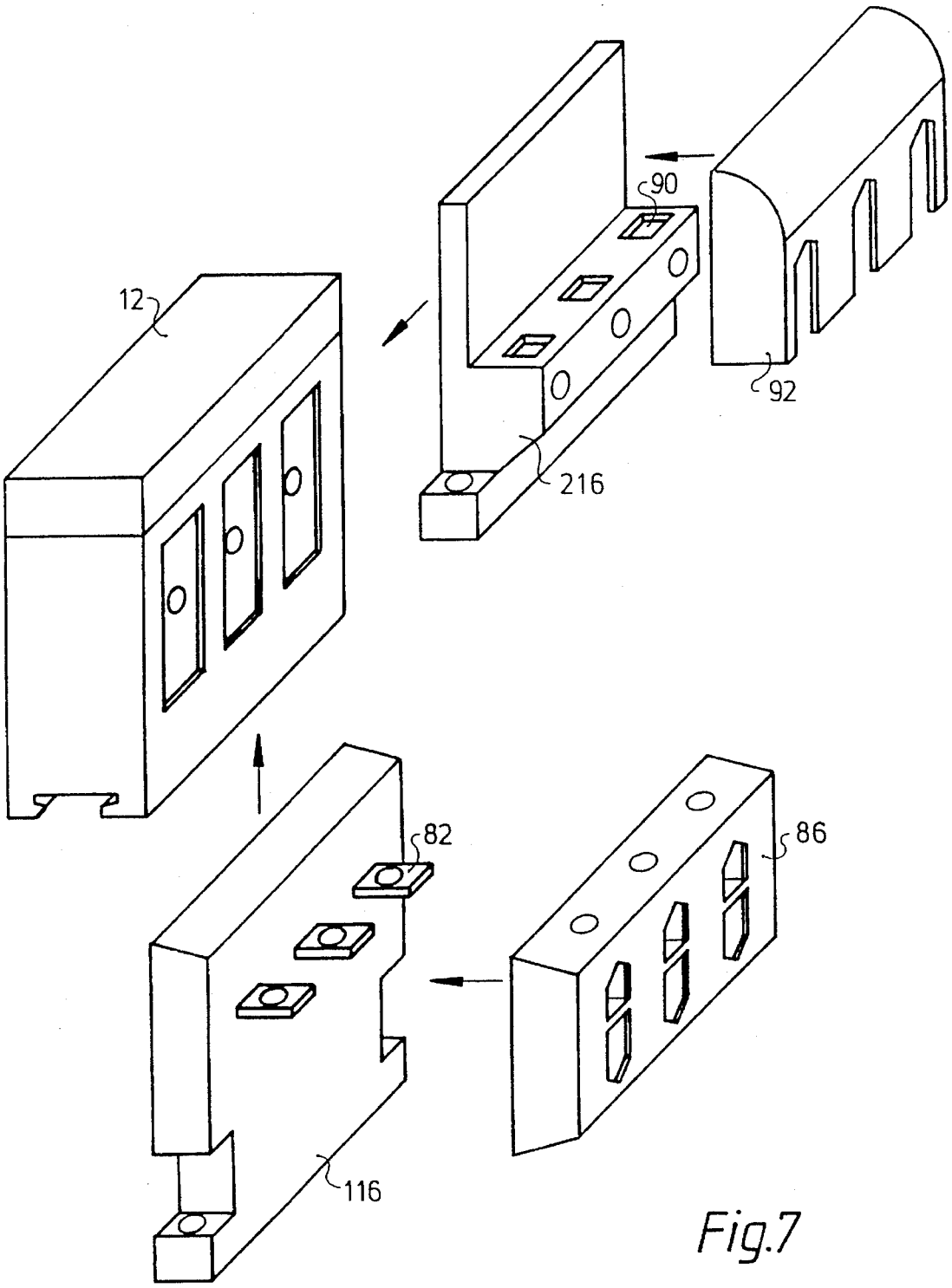
FIG. 7: a schematic illustration of various load-side embodiments of the overload relay according to the invention.

FIG. 7 shows how the basic unit can, as well as with the load-side terminal block 16 illustrated in FIG. 5, be connected to a selection of other terminal blocks 116 and 216 from one series on the load side, to fulfill the most varied connection requirements. The load-side terminal block 116, shown in the lower portion of the figure can essentially be identical to the contactor-side terminal block 114 shown in FIG. 6. The flat-type connectors 82 are preferably connected to flat conductors, which, in turn, are preferably connected to the load on the other end. If necessary, the box terminal unit 86 illustrated in FIG. 6 can conceivably be placed on the flat-type connectors 82. The load-side terminal block 216, illustrated in the upper portion of FIG. 7, with clamp connectors 90 can, for its part, essentially be identical to the contactor-side terminal block 114 described in detail in FIG. 6. The cover 92 was already described above with reference to FIG. 6.

One feature of the invention resides broadly in the overload relay to be combined with contactors, which is located in series between a contactor 2 and the electrical load to be switched and protected against overload, having the following characteristics:

the overload relay 10 consists of a basic unit 12 enclosed in a molded housing 26 and containing the overload protection mechanisms, of a terminal block 14, 114, 214, 314 equipped on the contactor side with phase connectors 22, 82, 88, 90 and enclosed in a molded housing, and a terminal block 16, 116, 216 equipped on the load side with phase connectors 74, 82, 90 and enclosed in a molded housing, the terminal blocks 14, 16, 114, 116, 214, 216, 314 are mechanically and electrically detachably connected to the basic unit 12, at least the basic unit 12 or the terminal blocks 14, 16, 114, 116, 214, 216, 314 has or have means for fastening 18, 24 to a mounting plate.

Another feature of the invention resides broadly in the overload relay to be combined with contactors, characterized by the fact that the contactor-side terminal block 14, 114, 214, 314 is compatible with the upstream contactor 2 in terms of its phase connectors 22, 82, 88, 90.

Still another feature of the invention resides broadly in the overload relay to be combined with contactors, characterized by the fact that the load-side terminal block 16, 116, 216 is compatible with the upstream contactor 2 in terms of its phase connectors 74, 82, 90.

Yet another feature of the invention resides broadly in the overload relay to be combined with contactors, which is located in series between a contactor 2 and the electrical load to be switched and protected against overload, having the following characteristics:

the overload relay 10 consists of a basic unit 12 enclosed in a molded housing 26 and containing the overload protection mechanisms, of a terminal block 14, 114, 214, 314 equipped on the contactor side with phase connectors 22, 82, 88, 90 and enclosed in a molded housing, and a terminal block 16, 116, 216 equipped on the load side with phase connectors 74, 82, 90 and enclosed in a molded housing, the terminal blocks 14, 16, 114, 116, 214, 216, 314 are mechanically and electrically detachably connected to the basic unit 12, at least the basic unit 912 or the terminal blocks 14, 16, 114, 116, 214, 216, 314 has or have means for fastening 18, 24 to a mounting plate, the terminal blocks 14, 16, 114, 116, 214, 216, 314 are all of a series which is compatible with at least two different contactors in terms of type and/or geometry of their connectors.

Still another feature of the invention resides broadly in the overload relay to be combined with contactors, characterized by the fact:

that the basic unit 12 contains, on each of the input and output sides for each phase, an adapter plate 34 accessible from the outside, which is positively connected to the molded housing 26, that for each phase, a connector 52, 78 is form-fitted into the molded housings 50, 72 of the terminal blocks 14, 16 and is an electrical and mechanical component of the phase connection 22, 74, that the connectors 52, 78 are connected by means of externally-accessible screw connections 42, 64, 66, 42, 64, 80 to the corresponding adapter plates 34.

Yet still another feature of the invention resides broadly in the overload relay to be combined with contactors, characterized by the fact that the adapter plates are oriented parallel to the terminal block side housing surfaces 32 of the basic unit 12, that the connectors 52, 78 are bent at a right angle and are in contact with one leg against the corresponding adapter plate 34, that the screw connections 42, 64, 66; 42, 64, 80 are oriented parallel to the phase input or output.

Another feature of the invention resides broadly in the overload relay to be combined with contactors, characterized by the fact that all the connectors 89 of at least one of the two terminal blocks 214 not corresponding to the middle phase are crimped, or offset, in a plane parallel to the mounting plane.

Yet another feature of the invention resides broadly in the overload relay to be combined with contactors, characterized by the fact that all the connectors 89 of at least one of the two terminal blocks 214 are crimped parallel to the mounting plane.

Still another feature of the invention resides broadly in the overload relay to be combined with contactors, characterized by the fact that the phase connectors of at least one of the two terminal blocks 14; 114; 116; 214 are plug-in connectors 22; 82; 88.

Yet still another feature of the invention resides broadly in the overload relay to be combined with contactors, characterized by the fact that the terminal block 14; 114; 116; 214 is of the same construction as a plug-in terminal unit which can be detachably connected to a combinable contactor.

Still yet another feature of the invention resides broadly in the overload relay to be combined with contactors, characterized by the fact that the plug-in connectors 22; 88 are bent to form the connectors 52; 89.

Yet another feature of the invention resides broadly in the overload relay to be combined with contactors, characterized by the fact that the plug-in connectors are designed as flat-type connectors 82 with connecting holes 84.

Still another feature of the invention resides broadly in the overload relay to be combined with contactors, characterized by the fact that the plug-in connectors 22 are adjustably fastened by means of the screw connections 42, 64, 66 with regard to their phase height 23.

Another feature of the invention resides broadly in the overload relay to be combined with contactors, characterized by the fact that there are slots 66 for the screw connections 42, 4, 66.

Yet another feature of the invention resides broadly in the overload relay to be combined with contactors, characterized by the fact that a relay base designed as a box terminal is inserted over the plug-in connectors and is detachably connected to them.

Still another feature of the invention resides broadly in the overload relay to be combined with contactors, characterized by the fact that the box terminal unit 86 is identical to the relay base of a contactor with which the relay can be combined.

Yet still another feature of the invention resides broadly in the overload relay to be combined with contactors, characterized by the fact that the phase connectors of at least one of the two terminal blocks 16, 216, 314 are clamp connectors 74, 90.

Still yet another feature of the invention resides broadly in the overload relay to be combined with contactors, characterized by the fact that the screw connections 42, 64, 80 are accessible via the terminal compartment of the terminal connections 74.

Another feature of the invention resides broadly in the overload relay to be combined with contactors, characterized by the fact that the terminal block 16, 216, 314 is identical with a terminal block which can be detachably connected to a contactor which can be combined with the relay.

Still another feature of the invention resides broadly in the overload relay to be combined with contactors, characterized by the fact that the terminal connectors are designed as box terminals 74.

Yet another feature of the invention resides broadly in the overload relay to be combined with contactors, characterized by the fact that for the clamp connectors 74, 90 of at least one of the two terminal blocks 16, 216, 314 there is a cover 81, 92.

Still yet another feature of the invention resides broadly in the overload relay to be combined with contactors, characterized by the fact that the cover 92 is identical with the cover of a combinable contactor.

Yet still another feature of the invention resides broadly in the overload relay to be combined with contactors, characterized by the fact that the terminal blocks 14, 16 are also detachably fastened to the basic unit 12 by means of additional mechanical connecting means 46, 48, 60, 44, 62.

Still another feature of the invention resides broadly in the overload relay to be combined with contactors, characterized by the fact that parts of the additional mechanical connecting means 46 on the bottom are recesses, which are designed as holes 48 for fastening with screws to a mounting plate or similar device.

Yet another feature of the invention resides broadly in the overload relay to be combined with contactors, characterized by the fact that the means for fastening on a mounting plate are threaded fastener means 24.

Another feature of the invention resides broadly in the overload relay to be combined with contactors, characterized by the fact that the means for fastening to a mounting plate are snap fastening means 18.

Still yet another feature of the invention resides broadly in the overload relay to be combined with contactors, characterized by the fact that there are also snap-fastening means.

Yet still another feature of the invention resides broadly in the overload relay to be combined with contactors, characterized by the fact that a control switch 20 is detachably fastened on the top of the basic unit 12.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 42 34 619, filed on Oct. 14, 1992, having inventors Klaus Lankuttis and Gerhard Rossmann, and DE-OS P 42 34 619 and DE-PS P 42 34 619, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. An overload relay and contactor in combination, said overload relay for being interfaced with an electrical load, at least a portion of said combination for being mounted on a mounting plate, said combination comprising:

said overload relay comprising a base unit, a first terminal block and a second terminal block;

said base unit being disposed between said first terminal block and said second terminal block;

said first terminal block being selectively detachable and attachable with said base unit;

said second terminal block being selectively detachable and attachable with said base unit;

means for connecting said first terminal block with said base unit;

means for connecting said second terminal block with said base unit;

said first terminal block being disposed adjacent said contactor and being selectively attachable and detachable with said contactor;

said second terminal block being configured for being connected with the electrical load and for being selectively attachable and detachable with the electrical load;

means disposed on said first terminal block for connecting said first terminal block with said contactor;

means disposed on said second terminal block for connecting said second terminal block with the electrical load;

said means connecting said first terminal block with said contactor comprising first phase connector means;

said means for connecting said second terminal block with the electrical load comprising second phase connector means; and said base unit comprising overload protection means;

said overload protection means comprising means for protecting the electrical load from an overload;

said base unit comprising a housing; and said overload protection means being disposed within said housing.

2. The combination according to claim 1, wherein at least one of: said first terminal block, said base unit and said second terminal block comprises fastening means, said fastening means comprising means for mounting said at least one of said first terminal block, said base unit and said second terminal block on the mounting plate.

3. The combination according to claim 2, wherein:

said means connecting said first terminal block with said base unit comprises mechanical connection means and electrical connection means; and said means connecting said second terminal block with said base unit comprises mechanical connection means and electrical connection means.

4. The combination according to claim 3, further comprising:

a first molded housing for enclosing said first terminal block;

a second molded housing for enclosing said second terminal block; and a third molded housing for enclosing said base unit.

5. The combination according to claim 4, wherein:

said first phase connector means are compatible with said contactor to render said overload relay compatible with said contactor.

6. The combination according to claim 5, wherein:

said means connecting said first terminal block and said base unit comprises a plurality of connectors, each said connector corresponding to a different phase, each said connector comprising said mechanical connection means and said electrical connection means, each said connector being form-fitted into said first molded housing.

7. The combination according to claim 6, wherein:

said means connecting said second terminal block and said base unit comprises a plurality of connectors, each said connector corresponding to a different phase, each said connector comprising said mechanical connection means and said electrical connection means, each said connector being form-fitted into said second molded housing;

said base unit comprises first adapter plate means and second adapter plate, said first and second adapter plate means both being disposed within said third molded housing;

said first adapter plate means being disposed towards said first terminal block;

said second adapter plate means being disposed towards said second terminal block;

means for accessing said first adapter plate means from outside said third molded housing;

means for accessing said second adapter plate means from outside said third molded housing;

said connectors of said means connecting said first terminal block and said base unit being a first set of connectors;

said first adapter plate means comprising a first set of adapter plates;

said second adapter plate means comprising a second set of adapter plates;

said connectors of said means connecting said second terminal block and said base unit being a second set of connectors;

each connector of said first set of connectors being connected to a corresponding one of said first set of adapter plates;

each connector of said second set of connectors being connected to a corresponding one of said second set of adapter plates;

said combination further comprises:

first screw connection means for connecting said each of said first set of connectors with its corresponding one of said first set of adapter plates; and second screw connection means for connecting said each of said second set of connectors with its corresponding one of said second set adapter plates;

said first screw connection means being accessible from outside said third molded housing via said means for accessing said first adapter plate from outside said third molded housing;

said second screw connection means being accessible from outside said third molded housing via said means for accessing said second adapter plate from outside said third molded housing;

said first adapter plate and said second adapter plate each being form-locked with said third molded housing;

said third molded housing comprising an upper surface, a lower surface, and a plurality of side surfaces;

a first of said side surfaces being adjacent said first terminal block;

a second of said side surfaces being adjacent said second terminal block;

said first and second side surfaces being planar and being parallel to one another;

said first set of adapter plates being oriented parallel to said first side surface;

said second set of adapter plates being oriented parallel to said second side surface;

each of said first set of connectors being bent at a right angle to form a generally horizontal leg and a vertical leg;

said vertical leg of each of said first set of connectors being directly interfaced with, and contacting, its corresponding one of said first set of adapter plates;

each of said second set of connectors being bent at a right angle to form a generally horizontal leg and a vertical leg;

said vertical leg of each of said second set of connectors being directly interfaced with, and contacting, its corresponding one of said second set of adapter plates;

said generally horizontal leg of each of said first set of connectors and each of said second set of connectors being configured for phase transmission;

said first screw connection means comprising a first set of screws, each of said first set of screws corresponding to a different one of said first set of connectors;

said second screw connection means comprising a second set of screws, each of said second set of screws corresponding to a different one of said second set of connectors;

each of said first set of screws being oriented parallel to said generally horizontal leg of each of said first set of connectors;

each of said second set of screws being oriented parallel to said generally horizontal leg of each of said second set of connectors;

said phase connector means connecting said first terminal block with said contactor comprising a third set of connectors;

said first set of connectors, said second set of connectors and said third set of connectors each comprising three connectors, each of said three connectors corresponding to a different phase;

said three connectors of said third set of connectors comprising a middle connector and two outer connectors flanking said middle connector;

said middle connector corresponding to a middle phase;

at least a portion of each of said three connectors of said third set of connectors being oriented in a corresponding horizontal plane;

said at least a portion of each of said two outer connectors being crimped so as to be oriented in a horizontal plane different from the horizontal plane in which said at least a portion of said middle connector is oriented;

each of said three connectors of said third set of connectors being mounted in said first terminal block along a horizontal mounting plane;

each said at least a portion of each of said three connectors of said third set of connectors being crimped so as to be oriented in a horizontal plane different from the horizontal mounting plane;

said phase connector means for connecting said second terminal block with the electrical load comprising a fourth set of connectors;

said fourth set of connectors comprising three connectors, each of said three connectors corresponding to a different phase;

said connectors of each of said third and fourth sets of connectors being plug-in connectors;

said plug-in connectors of said third set of connectors being attachable and detachable with said contactor;

said first set of connectors being the same as said third set of connectors;

said second set of connectors being the same as said fourth set of connectors;

each of said first set of connectors comprising a connecting hole for connecting with said contactor;

each of said first set of connectors comprising a flat end portion for connection with said contactor, said flat end portion comprising said connecting hole;

each of said first set of connectors being adjustable, with regard to phase height, by means of said first set of screws;

said vertical leg portion of each of said first set of connectors comprising slot means for accommodating a corresponding one of said first set of screws and for permitting adjustment of phase height;

said first terminal block comprises a relay base, said relay base comprising a box terminal being detachable and attachable with respect to said first set of connectors;

said contactor comprising a relay base;

said relay base of said first terminal block being identical to said relay base of said contactor;

each of said said second set of connectors comprising a clamp connector;

said second terminal block comprising a terminal compartment, said clamp connectors being disposed within said terminal compartment;

said second set of screws being accessible via said terminal compartment;

said second terminal block being identical with a terminal block which can be detachable and attachable with a contactor which can be combined with said overload relay;

said clamp connectors comprising box terminals;

said second terminal block comprising cover means for covering said clamp connectors;

said contactor comprising cover means;

said cover means of said second terminal block being identical to said cover means of said contactor;

said combination further comprises additional mechanical connecting means for mechanically connecting said first terminal block with said base unit and said second terminal block with said base unit;

a first portion of said additional mechanical connecting means being disposed at a lower portion of said base unit;

said first portion of said additional mechanical connecting means comprising hole means for screwably connecting said base unit with the mounting plate;

said fastening means comprising at least one of:

threaded fastener means disposed on said first terminal block and said second terminal block for fastening said first terminal block and said second terminal block onto the mounting plate; and snap fastening means disposed on said base unit for fastening said base unit onto a rail onto said mounting plate; and control switch means being attachable and detachable with an upper portion of said base unit.

8. An overload relay for being connected with a contactor, said overload relay for being interfaced with an electrical load, at least a portion of said overload relay for being mounted on a mounting plate, said overload relay comprising:

a base unit, a first terminal block and a second terminal block;

said base unit being disposed between said first terminal block and said second terminal block;

said first terminal block being selectively detachable and attachable with said base unit;

said second terminal block being selectively detachable and attachable with said base unit;

means for connecting said first terminal block with said base unit;

means for connecting said second terminal block with said base unit;

said first terminal block for being disposed adjacent the contactor and for being selectively attachable and detachable with the contactor;

said second terminal block being configured for being connected with the electrical load and for being selectively attachable and detachable with the electrical load;

means disposed on said first terminal block for connecting said first terminal block with the contactor;

means disposed on said second terminal block for connecting said second terminal block with the electrical load;

said means connecting said first terminal block with the contactor comprising phase connector means;

said means for connecting said second terminal block with the electrical load comprising phase connector means; and said base unit comprising overload protection means;

said overload protection means comprising means for protecting the electrical load from an overload;

said base unit comprising a housing; and said overload protection means being disposed within said housing.

9. The overload relay according to claim 8, wherein at least one of: said first terminal block, said base unit and said second terminal block comprises fastening means, said fastening means comprising means for mounting said at least one of said first terminal block, said base unit and said second terminal block on the mounting plate.

10. The overload relay according to claim 9, wherein:

said means connecting said first terminal block with said base unit comprises mechanical connection means and electrical connection means; and said means connecting said second terminal block with said base unit comprises mechanical connection means and electrical connection means.

11. The overload relay according to claim 10, further comprising:

a first molded housing for enclosing said first terminal block;

a second molded housing for enclosing said second terminal block; and a third molded housing for enclosing said base unit.

12. The overload relay according to claim 11, wherein:

said first phase connector means are for being compatible with the contactor to render said overload relay compatible with the contactor.

13. The overload relay according to claim 12, wherein:

said means connecting said first terminal block and said base unit comprises a plurality of connectors, each said connector corresponding to a different phase, each said connector comprising said mechanical connection means and said electrical connection means, each said connector being form-fitted into said first molded housing.

14. The overload relay according to claim 13, wherein:

said means connecting said second terminal block and said base unit comprises a plurality of connectors, each said connector corresponding to a different phase, each said connector comprising said mechanical connection means and said electrical connection means, each said connector being form-fitted into said second molded housing;

said base unit comprises first adapter plate means and second adapter plate, said first and second adapter plate means both being disposed within said third molded housing;

said first adapter plate means being disposed towards said first terminal block;

said second adapter plate means being disposed towards said second terminal block;

means for accessing said first adapter plate means from outside said third molded housing;

means for accessing said second adapter plate means from outside said third molded housing;

said connectors of said means connecting said first terminal block and said base unit being a first set of connectors;

said first adapter plate means comprising a first set of adapter plates;

said second adapter plate means comprising a second set of adapter plates;

said connectors of said means connecting said second terminal block and said base unit being a second set of connectors;

each connector of said first set of connectors being connected to a corresponding one of said first set of adapter plates;

each connector of said second set of connectors being connected to a corresponding one of said second set of adapter plates;

said combination further comprises:

first screw connection means for connecting said each of said first set of connectors with its corresponding one of said first set of adapter plates; and second screw connection means for connecting said each of said second set of connectors with its corresponding one of said second set adapter plates;

said first screw connection means being accessible from outside said third molded housing via said means for accessing said first adapter plate from outside said third molded housing;

said second screw connection means being accessible from outside said third molded housing via said means for accessing said second adapter plate from outside said third molded housing;

said first adapter plate and said second adapter plate each being form-locked with said third molded housing;

said third molded housing comprising an upper surface, a lower surface, and a plurality of side surfaces;

a first of said side surfaces being adjacent said first terminal block;

a second of said side surfaces being adjacent said second terminal block;

said first and second side surfaces being planar and being parallel to one another;

said first set of adapter plates being oriented parallel to said first side surface;

said second set of adapter plates being oriented parallel to said second side surface;

each of said first set of connectors being bent at a right angle to form a generally horizontal leg and a vertical leg;

said vertical leg of each of said first set of connectors being directly interfaced with, and contacting, its corresponding one of said first set of adapter plates;

each of said second set of connectors being bent at a right angle to form a generally horizontal leg and a vertical leg;

said vertical leg of each of said second set of connectors being directly interfaced with, and contacting, its corresponding one of said second set of adapter plates;

said generally horizontal leg of each of said first set of connectors and each of said second set of connectors being configured for phase transmission;

said first screw connection means comprising a first set of screws, each of said first set of screws corresponding to a different one of said first set of connectors;

said second screw connection means comprising a second set of screws, each of said second set of screws corresponding to a different one of said second set of connectors;

each of said first set of screws being oriented parallel to said generally horizontal leg of each of said first set of connectors;

each of said second set of screws being oriented parallel to said generally horizontal leg of each of said second set of connectors;

said phase connector means for connecting said first terminal block with the contactor comprising a third set of connectors;

said first set of connectors, said second set of connectors and said third set of connectors each comprising three connectors, each of said three connectors corresponding to a different phase;

said three connectors of said third set of connectors comprising a middle connector and two outer connectors flanking said middle connector;

said middle connector corresponding to a middle phase;

at least a portion of each of said three connectors of said third set of connectors being oriented in a corresponding horizontal plane;

said at least a portion of each of said two outer connectors being crimped so as to be oriented in a horizontal plane different from the horizontal plane in which said at least a portion of said middle connector is oriented;

each of said three connectors of said third set of connectors being mounted in said first terminal block along a horizontal mounting plane;

each said at least a portion of each of said three connectors of said third set of connectors being crimped so as to be oriented in a horizontal plane different from the horizontal mounting plane;

said phase connector means for connecting said second terminal block with the electrical load comprising a fourth set of connectors;

said fourth set of connectors comprising three connectors, each of said three connectors corresponding to a different phase;

said connectors of each of said third and fourth sets of connectors being plug-in connectors;

said plug-in connectors of said third set of connectors for being attachable and detachable with the contactor;

said first set of connectors being the same as said third set of connectors;

said second set of connectors being the same as said fourth set of connectors;

each of said first set of connectors comprising a connecting hole for connecting with the contactor;

each of said first set of connectors comprising a flat end portion for connection with the contactor, said flat end portion comprising said connecting hole;

each of said first set of connectors being adjustable, with regard to phase height, by means of said first set of screws;

said vertical leg portion of each of said first set of connectors comprising slot means for accommodating a corresponding one of said first set of screws and for permitting adjustment of phase height;

said first terminal block comprises a relay base, said relay base comprising a box terminal being detachable and attachable with respect to said first set of connectors;

the contactor comprising a relay base;

said relay base of said first terminal block is configured for being identical to said relay base of the contactor;

each of said said second set of connectors comprising a clamp connector;

said second terminal block comprising a terminal compartment, said clamp connectors being disposed within said terminal compartment;

said second set of screws being accessible via said terminal compartment;

said second terminal block being identical with a terminal block which is for being detachable and attachable with a contactor which can be combined with said overload relay;

said clamp connectors comprising box terminals;

said second terminal block comprising cover means for covering said clamp connectors;

the contactor comprises cover means;

said cover means of said second terminal block is configured for being identical to said cover means of the contactor;

said combination further comprises additional mechanical connecting means for mechanically connecting said first terminal block with said base unit and said second terminal block with said base unit;

a first portion of said additional mechanical connecting means being disposed at a lower portion of said base unit;

said first portion of said additional mechanical connecting means comprising hole means for screwably connecting said base unit with the mounting plate;

said fastening means comprising at least one of:

threaded fastener means disposed on said first terminal block and said second terminal block for fastening said first terminal block and said second terminal block onto the mounting plate; and snap fastening means disposed on said base unit for fastening said base unit onto a rail onto said mounting plate; and control switch means being attachable and detachable with an upper portion of said base unit.

15. A method of using a system for adapting various overload relays to various contactors, the overload relays and the contactors for being interfaced with an electrical load, said method comprising the steps of:

providing a plurality of overload relays;

configuring each of the plurality of overload relays to comprise overload protection means, the overload protection means comprising means for protecting an electrical load against an overload, each of the overload relays comprising a housing, the overload protection means being disposed within each housing;

providing a plurality of contactors;

providing a first set of adapters, each adapter of the first set of adapters for connecting at least one of the overload relays with at least one of the contactors;

providing a second set of adapters, each adapter of the second set of adapters for connecting at least one of the overload relays with the electrical load;

selecting a first adapter from the first set of adapters and connecting the first adapter of the first set of adapters between a first one of the plurality of overload relays and a first one of the plurality of contactors; and selecting a first adapter from the second set of adapters and connecting the first adapter of the second set of adapters between the first overload relay and the electrical load.

16. The method according to claim 15, wherein: the selected first adapter and the selected second adapter are both compatible with the first contactor, to render the selected overload relay compatible with the first contactor.

17. The method according to claim 16, wherein:

at least one of the first adapter and the second adapter is incompatible with at least one other of the plurality of contactors.

18. The method according to claim 17, wherein the overload relays are for being disposed on a mounting plate, said method further comprising the steps of:

providing fastening means on at least one of:
each of the first set of adapters;
each of the second set of adapters; and
each of the overload relays;

the fastening means comprising means for selectively mounting the at least one of:
each of the first set of adapters;
each of the second set of adapters; and
each of the overload relays;

on the mounting plate; and mounting at least one of:
the selected first adapter;
the selected second adapter; and
the selected overload relay;

on the mounting plate.

19. The method according to claim 18, wherein:

said step of providing a first set of adapters comprises providing means for connecting each of the first set of adapters with at least one of said plurality of overload relays;

said step of providing a second set of adapters comprises providing means for connecting each of the second set of adapters with at least one of the plurality of overload relays; and the connecting means of each of said first set of adapters and each of said second set of adapters comprising mechanical connection means and electrical connection means.

20. The combination according to claim 19, wherein, each first adapter is a first terminal block, each overload relay is a base unit and each second adapter is a second terminal block and, for a given set of a selected first terminal block, a selected base unit and a selected second terminal block:

a first molded housing is provided for enclosing the first terminal block;

a second molded housing is provided for enclosing the second terminal block;

a third molded housing is provided for enclosing the base unit;

the means connecting the first terminal block and the base unit comprises a plurality of connectors, each connector corresponding to a different phase, each connector comprising the mechanical connection means and the electrical connection means, each connector being form-fitted into the first molded housing.

the means connecting the second terminal block and the base unit comprises a plurality of connectors, each connector corresponding to a different phase, each connector comprising the mechanical connection means and the electrical connection means, each connector being form-fitted into the second molded housing;

the base unit comprises first adapter plate means and second adapter plate, the first and second adapter plate means both being disposed within the third molded housing;

the first adapter plate means being disposed towards the first terminal block;

the second adapter plate means being disposed towards the second terminal block;

means for accessing the first adapter plate means from outside the third molded housing;

means for accessing the second adapter plate means from outside the third molded housing;

the connectors of the means connecting the first terminal block and the base unit being a first set of connectors;

the first adapter plate means comprising a first set of adapter plates;

the second adapter plate means comprising a second set of adapter plates;

the connectors of the means connecting the second terminal block and the base unit being a second set of connectors;

each connector of the first set of connectors being connected to a corresponding one of the first set of adapter plates;

each connector of the second set of connectors being connected to a corresponding one of the second set of adapter plates;

the combination further comprises:
first screw connection means for connecting the each of the first set of connectors with its corresponding one of the first set of adapter plates; and
second screw connection means for connecting the each of the second set of connectors with its corresponding one of the second set adapter plates;

the first screw connection means being accessible from outside the third molded housing via the means for accessing the first adapter plate from outside the third molded housing;

the second screw connection means being accessible from outside the third molded housing via the means for accessing the second adapter plate from outside the third molded housing;

the first adapter plate and the second adapter plate each being form-locked with the third molded housing;

the third molded housing comprising an upper surface, a lower surface, and a plurality of side surfaces;

a first of the side surfaces being adjacent the first terminal block;

a second of the side surfaces being adjacent the second terminal block;

the first and second side surfaces being planar and being parallel to one another;

the first set of adapter plates being oriented parallel to the first side surface;

the second set of adapter plates being oriented parallel to the second side surface;

each of the first set of connectors being bent at a right angle to form a generally horizontal leg and a vertical leg;

the vertical leg of each of the first set of connectors being directly interfaced with, and contacting, its corresponding one of the first set of adapter plates;

each of the second set of connectors being bent at a right angle to form a generally horizontal leg and a vertical leg;

the vertical leg of each of the second set of connectors being directly interfaced with, and contacting, its corresponding one of the second set of adapter plates;

the generally horizontal leg of each of the first set of connectors and each of the second set of connectors being configured for phase transmission;

the first screw connection means comprising a first set of screws, each of the first set of screws corresponding to a different one of the first set of connectors;

the second screw connection means comprising a second set of screws, each of the second set of screws corresponding to a different one of the second set of connectors;

each of the first set of screws being oriented parallel to the generally horizontal leg of each of the first set of connectors;

each of the second set of screws being oriented parallel to the generally horizontal leg of each of the second set of connectors;

the phase connector means connecting the first terminal block with the contactor comprising a third set of connectors;

the first set of connectors, the second set of connectors and the third set of connectors each comprising three connectors, each of the three connectors corresponding to a different phase;

the three connectors of the third set of connectors comprising a middle connector and two outer connectors flanking the middle connector;

the middle connector corresponding to a middle phase;

at least a portion of each of the three connectors of the third set of connectors being oriented in a corresponding horizontal plane;

the at least a portion of each of the two outer connectors being crimped so as to be oriented in a horizontal plane different from the horizontal plane in which the at least a portion of the middle connector is oriented;

each of the three connectors of the third set of connectors being mounted in the first terminal block along a horizontal mounting plane;

each at least a portion of each of the three connectors of the third set of connectors being crimped so as to be oriented in a horizontal plane different from the horizontal mounting plane;

the phase connector means for connecting the second terminal block with the electrical load comprising a fourth set of connectors;

the fourth set of connectors comprising three connectors, each of the three connectors corresponding to a different phase;

the connectors of each of the third and fourth sets of connectors being plug-in connectors;

the plug-in connectors of the third set of connectors being attachable and detachable with the contactor;

the first set of connectors being the same as the third set of connectors;

the second set of connectors being the same as the fourth set of connectors;

each of the first set of connectors comprising a connecting hole for connecting with the contactor;

each of the first set of connectors comprising a flat end portion for connection with the contactor, the flat end portion comprising the connecting hole;

each of the first set of connectors being adjustable, with regard to phase height, by means of the first set of screws;

the vertical leg portion of each of the first set of connectors comprising slot means for accommodating a corresponding one of the first set of screws and for permitting adjustment of phase height;

the first terminal block comprises a relay base, the relay base comprising a box terminal being detachable and attachable with respect to the first set of connectors;

the contactor comprising a relay base;

the relay base of the first terminal block being identical to the relay base of the contactor;

each of the the second set of connectors comprising a clamp connector;

the second terminal block comprising a terminal compartment, the clamp connectors being disposed within the terminal compartment;

the second set of screws being accessible via the terminal compartment;

the second terminal block being identical with a terminal block which can be detachable and attachable with a contactor which can be combined with the overload relay;

the clamp connectors comprising box terminals;

the second terminal block comprising cover means for covering the clamp connectors;

the contactor comprising cover means;

the cover means of the second terminal block being identical to the cover means of the contactor;

the combination further comprises additional mechanical connecting means for mechanically connecting the first terminal block with the base unit and the second terminal block with the base unit;

a first portion of the additional mechanical connecting means being disposed at a lower portion of the base unit;

the first portion of the additional mechanical connecting means comprising hole means for screwably connecting the base unit with the mounting plate;

the fastening means comprising at least one of:

threaded fastener means disposed on the first terminal block and the second terminal block for fastening the first terminal block and the second terminal block onto the mounting plate; and snap fastening means disposed on the base unit for fastening the base unit onto a rail onto the mounting plate;

control switch means are provided and are attachable and detachable with an upper portion of the base unit;

at least one of the contactors is from a different manufacturer than at least one of the base units; and at least one of the first terminal blocks and at least one of the second terminal blocks are configured for rendering compatible the at least one of the contactors and the at least one of the base units from different manufacturers.

* * * * *

UNITED STATES PATENT AND TRADEMARK OFFICE

CERTIFICATE OF CORRECTION

PATENT NO. : 5,483,212

DATED : January 9, 1996

INVENTOR(S) : Klaus LANKUTTIS and Gerhard ROSSMANN

It is certified that error appears in the above-indentified patent and that said Letters Patent is hereby corrected as shown below:

In column 11, line 11, after '42,' delete "4," and insert --64,--.

Signed and Sealed this

Twenty-sixth Day of November 1996

*Attest:*

*Attesting Officer*

BRUCE LEHMAN

*Commissioner of Patents and Trademarks*